US008056544B2

(12) United States Patent
Webb et al.

(10) Patent No.: US 8,056,544 B2
(45) Date of Patent: Nov. 15, 2011

(54) EXHAUST GAS RECIRCULATION (EGR) SYSTEM

(75) Inventors: Timothy Webb, Ann Arbor, MI (US); Jeffrey B. Schneyer, Farmington Hills, MI (US); Kevin R. Murphy, Troy, MI (US); Christopher Oberski, Plymouth, MI (US); Peter Mitchell Lyon, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 748 days.

(21) Appl. No.: 12/199,342

(22) Filed: Aug. 27, 2008

(65) Prior Publication Data

US 2010/0051001 A1 Mar. 4, 2010

(51) Int. Cl.

| | |
|---|---|
| ***F02M 25/07*** | (2006.01) |
| ***F02B 47/08*** | (2006.01) |
| ***F02B 33/44*** | (2006.01) |
| ***F28G 1/12*** | (2006.01) |

(52) U.S. Cl. ..... 123/568.12; 123/568.16; 123/698; 60/605.2; 702/183; 165/95

(58) Field of Classification Search ..... 123/568.12, 123/568.21, 568.31, 478, 480, 435, 698, 123/41.31, 568.16; 60/605.2, 311, 286, 274, 60/277–279; 701/108; 702/182, 183; 165/94, 165/95

See application file for complete search history.

(56) References Cited

U.S. PATENT DOCUMENTS

| | | | | |
|---|---|---|---|---|
| 6,666,201 | B1 * | 12/2003 | Mazur | 123/698 |
| 6,681,564 | B2 * | 1/2004 | Nishiyama et al. | 60/285 |
| 6,708,487 | B2 | 3/2004 | Morimoto et al. | |
| 6,826,903 | B2 | 12/2004 | Yahata et al. | |
| 6,901,746 | B2 * | 6/2005 | Nishiyama et al. | 60/285 |
| 7,178,326 | B2 * | 2/2007 | Kojima et al. | 60/278 |
| 7,210,469 | B1 | 5/2007 | Saele | |
| 7,778,766 | B1 * | 8/2010 | Cowgill et al. | 701/108 |
| 2003/0225503 | A1 * | 12/2003 | Mazur | 701/108 |
| 2004/0045280 | A1 * | 3/2004 | Nishiyama et al. | 60/278 |
| 2006/0075740 | A1 * | 4/2006 | Twigg et al. | 60/285 |
| 2006/0117751 | A1 * | 6/2006 | Todoroki et al. | 60/612 |
| 2006/0200297 | A1 * | 9/2006 | Liu et al. | 701/104 |

FOREIGN PATENT DOCUMENTS

| | | | |
|---|---|---|---|
| DE | 10112257 | | 10/2001 |
| JP | 10103161 | * | 4/1998 |

* cited by examiner

*Primary Examiner* — Willis Wolfe, Jr.
*Assistant Examiner* — Johnny Hoang

(57) ABSTRACT

A method for operating an internal combustion engine Exhaust Gas Recirculation (EGR) system that includes producing an EGR valve position signal to decrease the amount of exhaust gas passed to the EGR cooler when a processor determines the EGR cooler efficiency is less than the predetermined level and producing an EGR coolant valve position signal to decrease the amount of coolant passed to the EGR cooler when such processor determines the EGR cooler efficiency is less than the predetermined level. The processor produced EGR valve and the EGR coolant valve position signals result in regeneration within the cooler, returning the effectiveness of the cooler to a near "clean" condition.

22 Claims, 3 Drawing Sheets

EXHAUST GAS RECIRCULATION (EGR) SYSTEM

TECHNICAL FIELD

This invention relates generally to exhaust gas recirculation (EGR) systems and more particularly to EGR systems having EGR regeneration.

BACKGROUND

As is known in the art, the effectiveness of the EGR coolers degrade as a function of engine run time, level of cooling, and EGR rate. More particularly, EGR coolers lose effectives as soot builds up on the surface of the coolers. The soot layer acts as an insulator preventing heat transfer from the gas to the coolant. Under the engine operating conditions expected for 2010 diesel applications, the level and rate of EGR cooler fouling may require a service procedure or an intrusive "cooler regeneration" mode. Servicing the cooler at the dealership would be very expensive and inconvenient for the customer.

SUMMARY

In accordance with the invention, a method is provided for operating an internal combustion engine Exhaust Gas Recirculation (EGR) system, such system having: an air intake to the engine; an exhaust gas recirculation (EGR) path for directing a portion of exhaust gas produced by the engine into the air intake; such exhaust gas recirculation path comprising: an EGR cooler for cooling the exhaust gas as such exhaust gas passes through the EGR path to the air intake; an EGR valve operative in response to an EGR valve position signal produced by the processor for controlling the amount of the exhaust gas fed to the EGR cooler. The method includes: producing the EGR valve position signal in accordance with a difference between actual engine exhaust NOx and a preset NOx level.

In one embodiment, the method produces the EGR valve position signal in accordance with a difference between actual engine exhaust NOx and a first, relatively low preset NOx level when the processor determines EGR cooler efficiency is greater than a predetermined level; and produces, when the processor determines EGR cooler efficiency is less than the predetermined level, the EGR valve position signal in accordance with a difference between actual engine exhaust NOx and a second, relatively high preset NOx level and producing an EGR coolant valve position signal to decrease the amount of coolant passed to the EGR cooler when such processor determines the actual EGR gas outlet temperature is less than the a preset EGR gas outlet temperature, such EGR valve position and EGR cooler valve position being operated to decrease the amount of exhaust gas passed to the EGR cooler and to decrease the amount of coolant passed to the EGR cooler In one embodiment, a method is provided for operating an internal combustion engine Exhaust Gas Recirculation (EGR) system. The system includes: a processor; an air intake to the engine; an exhaust gas recirculation (EGR) path for directing a portion of exhaust gas produced by the engine into the air intake; such exhaust gas recirculation path comprising: an EGR cooler for cooling the exhaust gas as such exhaust gas passes through the EGR path to the air intake; an EGR valve operative in response to an EGR valve position signal produced by the processor for controlling the amount of the exhaust gas fed to the EGR cooler. The method comprises:

producing the EGR valve position signal in accordance with a difference between actual engine exhaust NOx and a preset NOx level when such processor determines the EGR cooler efficiency is less than the predetermined level, such produced EGR valve position signal being operated to decrease the amount of exhaust gas passed to the EGR cooler.

In one embodiment, wherein the engine includes: an EGR coolant supply for providing a coolant to the EGR cooler; and a EGR coolant valve operative in response to an EGR coolant valve position signal produced by the processor for controlling the amount of the coolant fed to the EGR cooler. The method includes producing the EGR coolant valve position signal in accordance with a difference between actual EGR cooler gas outlet temperature and a preset EGR gas cooler outlet temperature, such produced EGR coolant valve position signal being operated to decrease the amount of coolant passed to the EGR cooler when such processor determines the EGR cooler efficiency is less than the predetermined level.

In one embodiment, an Exhaust Gas Recirculation (EGR) system is provided, having: a processor; an air intake to the engine; and an exhaust gas recirculation (EGR) path for directing a portion of exhaust gas produced by the engine into the air intake. The EGR path includes: an EGR cooler for cooling the exhaust gas as such exhaust gas passes through the EGR path to the air intake; an EGR valve operative in response to an EGR valve position signal produced by the processor for controlling the amount of the exhaust gas fed to the EGR cooler; an EGR coolant supply for providing a coolant to the EGR cooler; and a EGR coolant valve operative in response to an EGR coolant valve position signal produced by the processor for controlling the amount of the coolant fed to the EGR cooler. The processor produces the EGR valve and the EGR coolant valve position signals when such processor determines the EGR cooler efficiency is below a predetermined level. The processor produced EGR valve and the EGR coolant valve position signals result in regeneration within the cooler, such regeneration burning excess soot built-up in the cooler, such built-up soot reducing the efficiency of the cooler.

With such an arrangement, a passive soot-regenerating mode is activated with the efficiency of the EGR cooler is determined by the processor to be below a predetermined level. Passive soot regeneration (or combustion) occurs in a $NO_x$ rich environment ($NO_x$ to Soot ratio>8) at engine coolant temperatures greater than 300 degrees C. Through engine calibration and coolant flow modulation, it is possible to create this condition in the EGR cooler and to nearly restore the effectives of the cooler to a "clean state".

In one embodiment, the exhaust gas recirculation (EGR) path includes: an EGR cooler input temperature sensor for producing a signal to the processor representative of the temperature of the portion of the exhaust gas fed to the EGR cooler; an EGR cooler output temperature sensor for producing a signal to the processor representative of the temperature of the portion of the exhaust gas exiting the EGR cooler; an EGR input coolant temperature sensor for producing a signal to the processor representative of the temperature of EGR coolant entering the EGR cooler from the EGR coolant supply; and an EGR outlet coolant temperature sensor for producing a signal to the processor representative of the temperature of EGR coolant exiting the EGR cooler to the EGR coolant supply. The processor determines EGR cooler efficiency in response to the temperature of the portion of the exhaust gas fed to the EGR cooler, the temperature of the portion of the exhaust gas exiting the EGR cooler, temperature of EGR coolant entering the EGR cooler and the temperature of EGR coolant exiting the EGR cooler.

In one embodiment, the EGR valve position signal is related to engine NOx.

In one embodiment, the EGR coolant valve position signal is related the temperature of EGR gas temperature exiting the EGR cooler.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
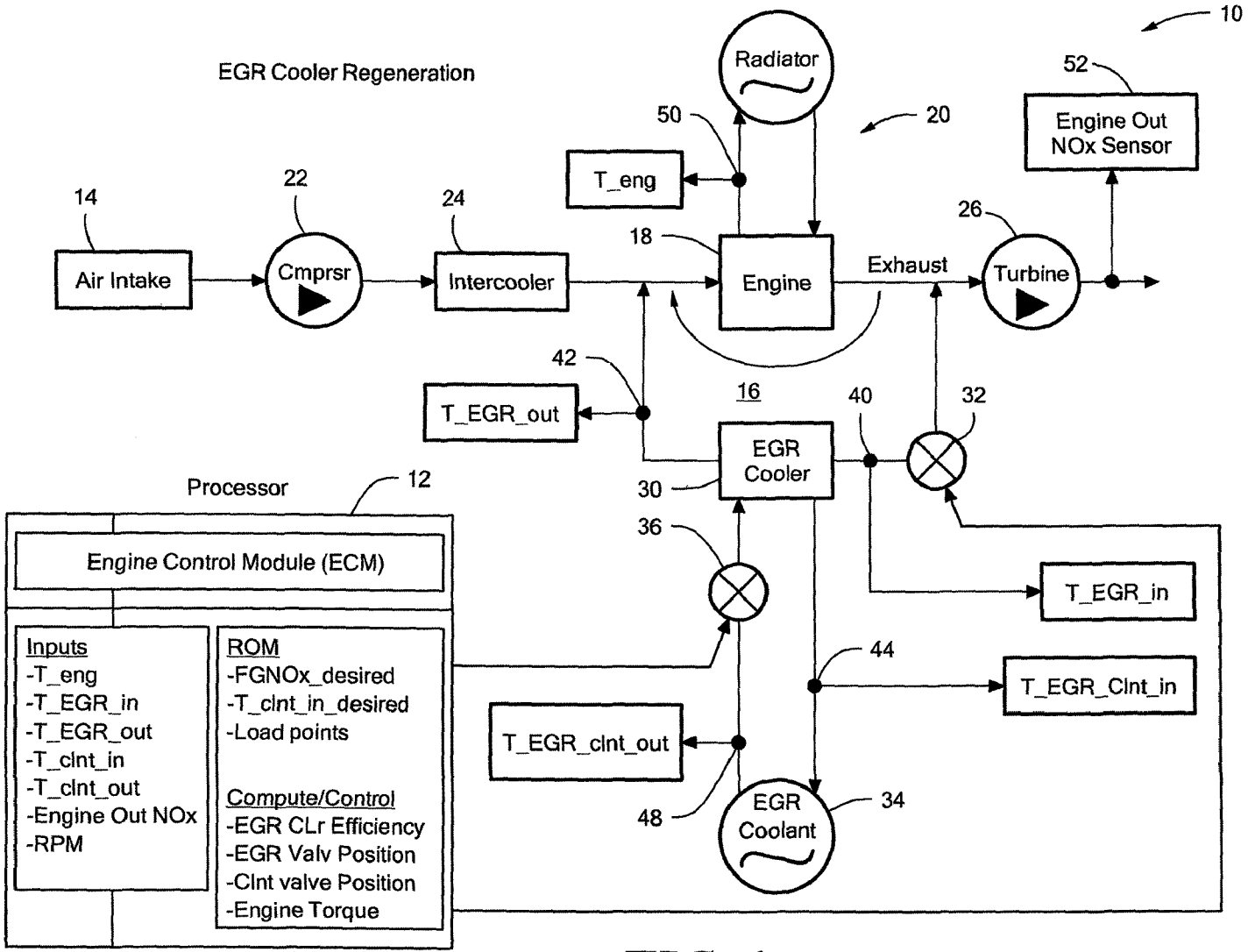
FIG. 1 is a block diagram of an internal combustion engine Exhaust Gas Recirculation (EGR) system according to the invention'

Referring now to FIG. 1, an internal combustion engine Exhaust Gas Recirculation (EGR) system 10 is shown. The system includes a processor (Engine Control Module (ECM)) 12; an air intake to the engine 14; an exhaust gas recirculation (EGR) path 16 for directing a portion of exhaust gas produced by an engine 18 into the air intake 14 and an engine cooling system 20. Here the engine 18 is a diesel engine having a compressor 22, intercooler 24, and a turbine 26 arranged in a conventional manner, as shown.

The exhaust gas recirculation path 16 includes: an EGR cooler 30 for cooling the exhaust gas as such exhaust gas passes through the EGR path 16 to the air intake 14; an EGR valve 32 operative in response to an EGR valve position signal produced by the processor 12 for controlling the amount of the exhaust gas fed to the EGR cooler 30; an EGR coolant supply 34 for providing a coolant to the EGR cooler 30; a EGR coolant valve 36 operative in response to an EGR coolant valve position signal produced by the processor 12 for controlling the amount of the coolant fed to the EGR cooler 30; an EGR cooler input temperature sensor 40 for producing a temperature signal (T_EGR_in) to the processor 12 representative of the temperature of the portion of the exhaust gas fed to the EGR cooler 30; an EGR cooler output temperature sensor 42 for producing a temperature signal (T_EGR_out) to the processor 12 representative of the temperature of the portion of the exhaust gas exiting the EGR cooler 30; an EGR input coolant temperature sensor 44 for producing a temperature signal (T_EGRClnt_in) to the processor 12 representative of the temperature of EGR coolant exiting the EGR cooler 30 to the EGR coolant supply 34; and an EGR outlet coolant temperature sensor 48 for producing a temperature signal (T_EGRclnt_out) to the processor 12 representative of the temperature of EGR coolant entering the EGR cooler from the EGR coolant supply 34. A temperature sensor 50 is used to measure the engine coolant temperature. ECT (T_eng). The set point for EGR exhaust gas exiting the cooler is higher in cleaning mode than in normal mode The processor 12 produces the EGR valve 32 position signal and the EGR coolant valve 34 position signal when such processor 12 determines the EGR cooler efficiency is below a predetermined level. The processor 12 produced EGR valve 32 and the EGR coolant valve 34 position signals results in regeneration within the cooler 32, such regeneration burning excess soot built-up in the cooler 30, such built-up soot reducing the efficiency of the cooler 30.

More particularly, and as will be described in more detail in connection with FIGS. 2 and 3, the processor 12 operates to produce the EGR valve 32 position signal in accordance with a difference between actual engine exhaust (i.e., feedgas (FG) NOx, FGNOx_actual, measured with a NOx sensor 52, as shown, or determined from maps generated for the engine 18 as a function of measured engine 18 operating parameters) and a first, relatively low preset NOx level (FGNOx_Set) when the cooler 30 efficiency is greater than a predetermined efficiency level, and produce the EGR valve 32 position signal in accordance with a difference between actual engine exhaust NOx and a second, relatively high preset NOx level when such processor 12 determines the EGR cooler 30 efficiency is less than the predetermined level. Such produced the EGR valve 32 position signal being operated to decrease the amount of exhaust gas passed to the EGR cooler 30 when such processor 12 determines the EGR cooler 30 efficiency is less than the predetermined level and the actual engine exhaust NOx is less than the second, relatively high preset NOx level. Further, the processor 12 produces the EGR coolant valve 32 position signal in accordance with a difference between actual EGR cooler gas outlet temperature (EGR_out) and a preset EGR cooler gas outlet temperature (TEGR_out_Set, determined by an engine calibration and then generating from such calibration a map relating a set EGR cooler gas out of for example 300 degrees C. to 450 degrees C. as a function of engine 18 speed, n, and measured or calculated engine torque or load (e.g., air flow mass)), such produced EGR coolant valve 32 position signal being operated to decrease the amount of coolant passed to the EGR cooler 30 when such processor determines the EGR cooler efficiency is less than the predetermined level and the actual EGR cooler outlet gas temperature is less than the a preset EGR cooler outlet gas outlet temperature. Therefore, the processor 12 produced EGR valve 32 and the EGR coolant valve 36 position signals results in regeneration within the cooler 30, such regeneration burning excess soot built-up in the cooler 30, such built-up soot reducing the efficiency of the cooler 30.

Figure 2:
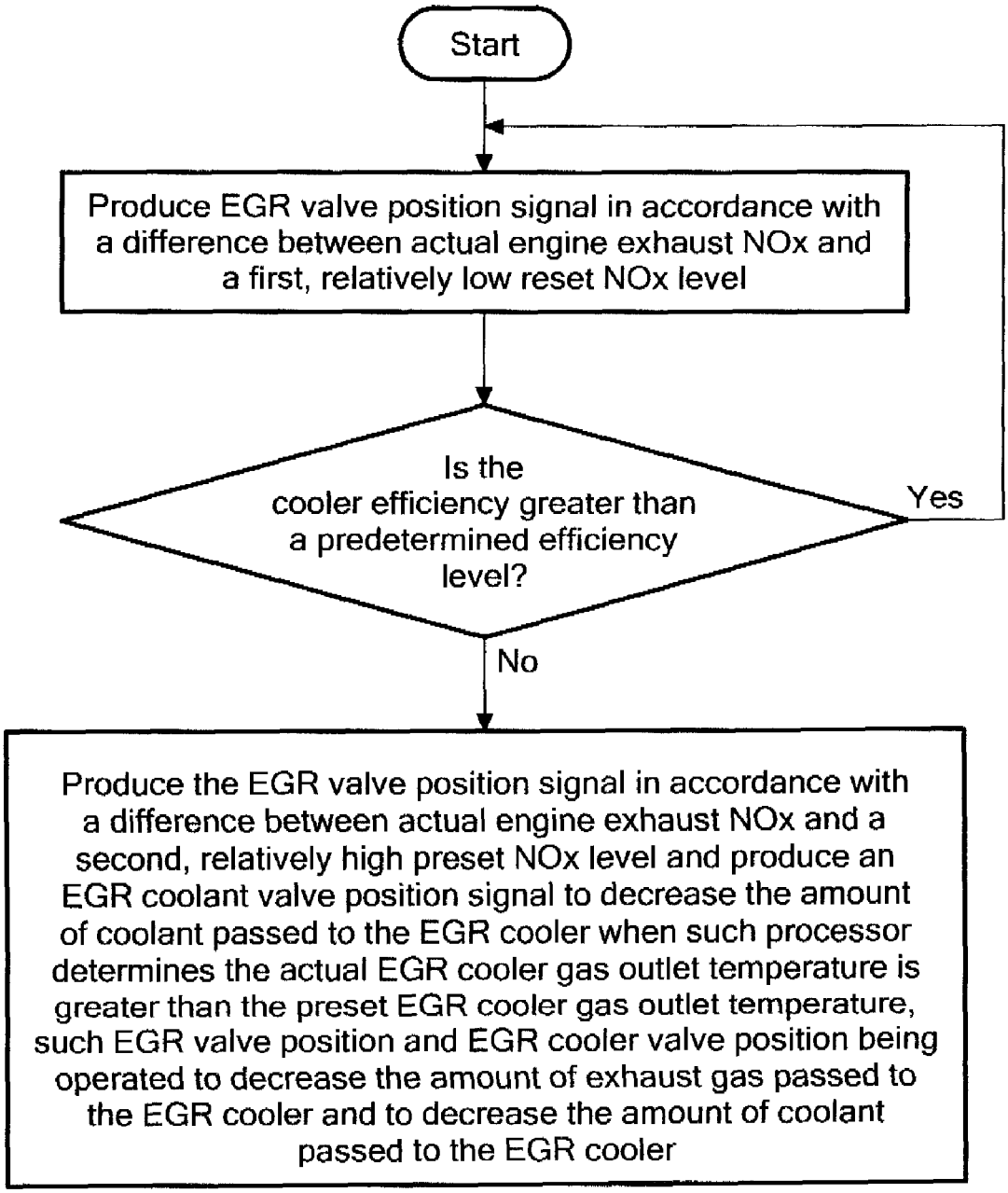
FIG. 2 is an overall flowchart of the method operating the system of FIG. 1 according to the invention.

Referring now to FIG. 2, a flowchart of the method used to control the EGR system 10 of FIG. 1 is shown. The program represented by such flowchart is here stored in a ROM or other storage media in the processor 12. The method produces the EGR valve position signal in accordance with a difference between actual engine exhaust NOx and a preset NOx level when such processor determines the EGR cooler efficiency is less than the predetermined level, such produced the EGR valve position signal being operated to decrease the amount of exhaust gas passed to the EGR cooler when such processor determines the EGR cooler efficiency is less than the predetermined level and the actual engine exhaust NOx is less than the second, relatively high preset NOx level. Here, the second, relatively high preset NOx level is such that the NOx to particulate mass ratio is greater than or equal to 8.

More particularly, as shown in FIG. 2, the method produces the EGR valve position signal in accordance with a difference between actual engine exhaust NOx and a first, relatively low preset NOx level when the processor determines EGR efficiency is greater than a predetermined level; and produces, when the processor determines EGR efficiency is less than the predetermined level, the EGR valve position signal in accordance with a difference between actual engine exhaust NOx and a second, relatively high preset NOx level and producing an EGR coolant valve position signal to decrease the amount of coolant passed to the EGR cooler when such processor determines the actual EGR cooler gas outlet temperature is less than the a preset EGR cooler gas outlet temperature, such EGR valve position and EGR cooler valve position being operated to decrease the amount of exhaust gas passed to the EGR cooler and to decrease the amount of coolant passed to the EGR cooler.

Further, the method produces the EGR coolant valve position signal in accordance with a difference between actual EGR cooler gas outlet temperature and a preset EGR cooler gas outlet temperature, typically 300 degrees C. to 450 degrees C., such produced EGR coolant valve position signal being operated to decrease the amount of coolant passed to the EGR cooler when such processor determines the EGR cooler efficiency is less than the predetermined level and the actual EGR cooler gas outlet temperature is equal to or less than the a preset EGR cooler gas outlet temperature.

Figure 3:
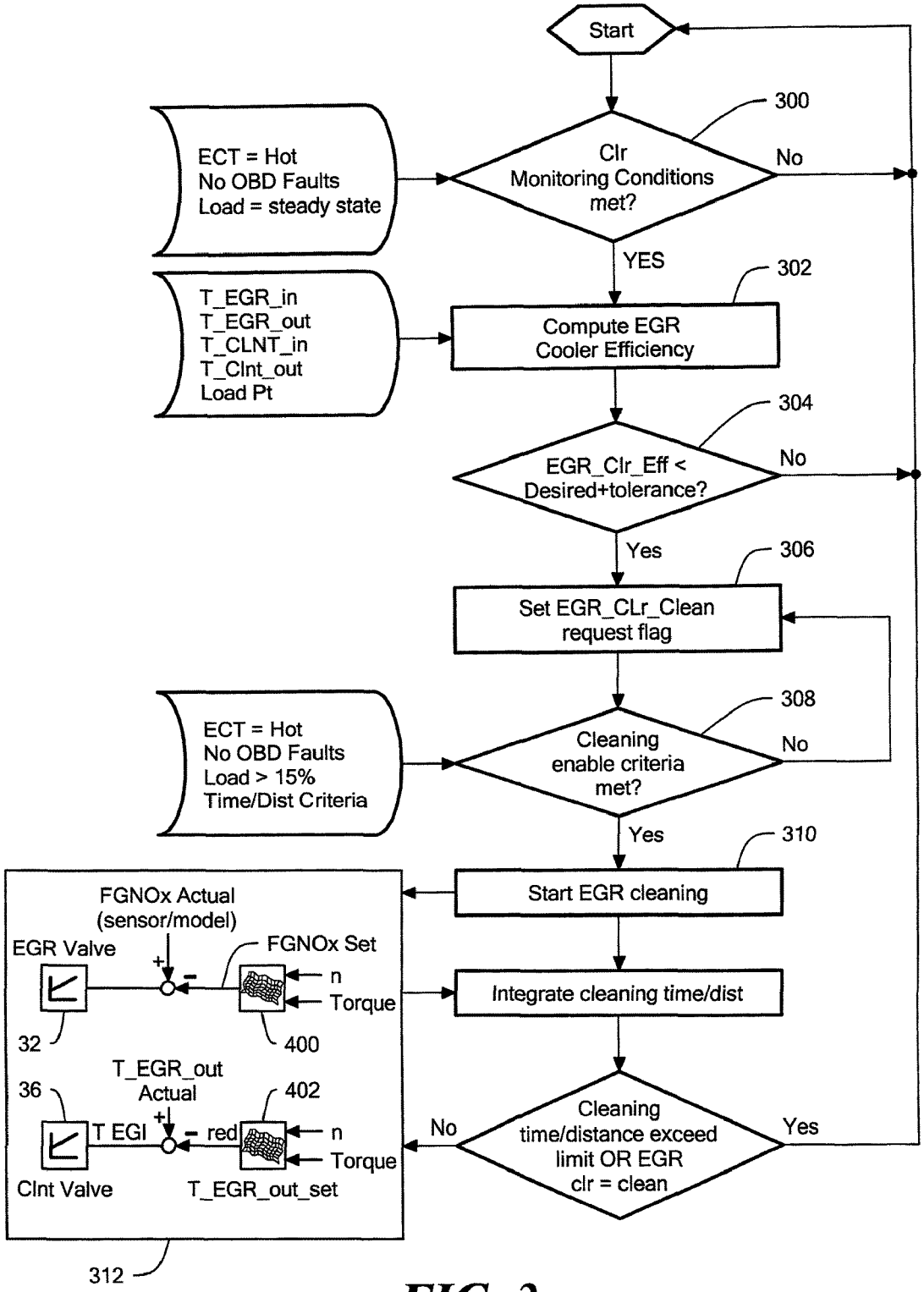
FIG. 3 is a more detailed overall flowchart of the method operating the system of FIG. 1 according to the invention.

Referring now to FIG. 3, a more detailed flowchart of the method is shown. The method determines whether cooler 30 cleaning conditions are met, Step 300. That is the processor 12 examines the engine coolant temperature T_eng, determines whether there are any on board (OBD) faults and whether is engine is operating (engine load) in a relatively steady state. If the engine temperature is at normal operating temperature, if there are no on board faults and if the engine is at a steady state operating condition, the processor 12 computes the EGR cooler 30 efficiency; where efficiency is a function of the ratio of the exhaust gas temperature drop across the EGR cooler (T_EGR_in-TEGR_out) to an ideal temperature drop (T_EGR_in-T_EGRClnt_in) from temperature sensor 40 (T_EGR_in), temperature sensor 36 TEGR_out, and temperature sensor 40 T_EGRClnt_in at a predetermined engine load point, such as an engine speed of 2000 RPM and a torque of 300 Nm, Step 302.

If the processor 12 determines that the EGR cooler 30 efficiency is less than a predetermined level, Step 304, a flag is set, Set 306 and the EGR cooler 30 cleaning process commences, if a cleaning enable criteria is met, Step 308. Here the criteria is that the engine 18 is at normal operating temperature, there are no OBD faults, the engine torque is greater than a predetermined level, for example 15% of maximum torque and a predetermined period of has passed since the last EGR cooler 30 cleaning process, for example 1000 miles).

If the cleaning enable criterion is met, the EGR cooler 30 process commences, Step 312. More particularly, the processor 12 compares the actual engine NOx, FGNOx with the preset FGNOx_Set. As noted above, FGNOx_Set is determined by an engine calibration and then generating from such calibration a map 450 relating a set FGNOx such that a NOx to particulate mass, for example a ratio of 15, as distinguished a ratio of <4 used in the normal engine operating node to control the EGR valve 32. If the actual engine NOx is less than the FGNOx_Set, the EGR valve 32 decreases the EGR flow whereas if the actual engine NOx is greater than the FGNOx_Set, the EGR valve 32 increases the EGR flow.

Also, the cooler valve 34 is controlled to maintain the EGR cooler gas outlet temperature of, for example, between 300 degrees C. and 450 degrees C. As noted above, TEGR_out_Set, is determined by an engine calibration and then generating from such calibration a map 402 relating a set EGR cooler gas outlet temperature of for example 300 degrees C. to 450 degrees C. as a function of engine 18 speed, n, and measured or calculated engine torque or load (e.g., air flow mass)). If the actual EGR cooler gas outlet temperature is greater than TEGR_out_Set, the cooler valve 34 increases the coolant flow to the cooler 30 whereas if the actual EGR cooler gas outlet temperature is less than TEGR_out_Set, the cooler valve 34 valve decreases the coolant flow to the cooler 30.

The cleaning process in Step 312 continues for a predetermined time or vehicle distance after which the cleaning process terminates and returns to Step 300.

A number of embodiments of the invention have been described. Nevertheless, it will be understood that various modifications may be made without departing from the spirit and scope of the invention. For example, a catalyst, such as for example, a diesel oxidation catalyst may be included in the exhaust gas recirculation path includes upstream of the EGR valve to increase the regeneration and thus soot burning in the EGR cooler. Accordingly, other embodiments are within the scope of the following claims.

What is claimed is:

1. A method for operating an internal combustion engine Exhaust Gas Recirculation (EGR) system, such system having: a processor; an air intake to the engine; an exhaust gas recirculation (EGR) path for directing a portion of exhaust gas produced by the engine into the air intake; such exhaust gas recirculation path comprising: an EGR cooler for cooling the exhaust gas as such exhaust gas passes through the EGR path to the air intake; an EGR valve operative in response to an EGR valve position signal produced by the processor for controlling the amount of the exhaust gas fed to the EGR cooler, the method comprising:

producing the EGR valve position signal in accordance with a difference between actual engine exhaust NOx and a preset NOx level when such processor determines the EGR cooler efficiency is less than the predetermined level, such produced the EGR valve position signal being operated to decrease the amount of exhaust gas passed to the EGR cooler when such processor determines EGR cooler efficiency is less than the predetermined level;

wherein the engine includes: an EGR coolant supply for providing a coolant to the EGR cooler; and a EGR coolant valve operative in response to an EGR coolant valve position signal produced by the processor for controlling the amount of the coolant fed to the EGR cooler, and including:

producing the EGR coolant valve position signal in accordance with a difference between actual EGR cooler gas outlet temperature and a preset EGR cooler gas outlet temperature, such produced EGR coolant valve position signal being operated to decrease the amount of coolant passed to the EGR cooler when such processor determines the EGR cooler efficiency is less than the predetermined level.

2. An internal combustion engine Exhaust Gas Recirculation (EGR) system, comprising:

a processor;

an air intake to the engine;

an exhaust gas recirculation (EGR) path for directing a portion of exhaust gas produced by the engine into the air intake; such exhaust gas recirculation path comprising:

an EGR cooler for cooling the exhaust gas as such exhaust gas passes through the EGR path to the air intake;

an EGR valve operative in response to an EGR valve position signal produced by the processor for controlling the amount of the exhaust gas fed to the EGR cooler; and wherein the processor produces the EGR valve position signal when such processor determines the EGR cooler efficiency is below a predetermined level, such EGR valve position signal being a function of engine exhaust gas Nox, and;

wherein the system includes:

an EGR coolant supply for providing a coolant to the EGR cooler;

a EGR coolant valve operative in response to an EGR coolant valve position signal produced by the processor for controlling the amount of the coolant fed to the EGR cooler; and wherein the processor produces the EGR valve position signal when such processor determines the EGR cooler efficiency is below a predetermined level, such EGR valve position signal being a function of engine exhaust gas NOx and EGR coolant temperature.

3. The system recited in claim 2 wherein the processor produced EGR valve and the EGR coolant valve position signals results in regeneration within the cooler, such regeneration burning excess soot built-up in the cooler, such built-up soot reducing the efficiency of the cooler.

4. The system recited in claim 2 wherein the processor produced EGR valve and the EGR coolant valve position signals results in regeneration within the cooler, such regeneration burning excess soot built-up in the cooler, such built-up soot reducing the efficiency of the cooler.

5. The system recited in claim 4 wherein the EGR coolant valve position signal is related the temperature of EGR coolant entering the EGR.

6. An internal combustion engine Exhaust Gas Recirculation (EGR) system, comprising:

a processor;

an air intake to the engine;

an exhaust gas recirculation (EGR) path for directing a portion of exhaust gas produced by the engine into the air intake; such exhaust gas recirculation path comprising:

an EGR cooler for cooling the exhaust gas as such exhaust gas passes through the EGR path to the air intake;

an EGR valve operative in response to an EGR valve position signal produced by the processor for controlling the amount of the exhaust gas fed to the EGR cooler;

an EGR coolant supply for providing a coolant to the EGR cooler;

a EGR coolant valve operative in response to an EGR coolant valve position signal produced by the processor for controlling the amount of the coolant fed to the EGR cooler; and wherein the processor produces the EGR valve position signal and the EGR coolant valve position signal when such processor determines the EGR cooler efficiency is below a predetermined level.

7. The system recited in claim 6 wherein the processor produced EGR valve and the EGR coolant valve position signals results in regeneration within the cooler, such regeneration burning excess soot built-up in the cooler, such built-up soot reducing the efficiency of the cooler.

8. The system recited in claim 7 wherein the exhaust gas recirculation (EGR) path includes:

an EGR cooler input temperature sensor for producing a signal to the processor representative of the temperature of the portion of the exhaust gas fed to the EGR cooler;

an EGR cooler output temperature sensor for producing a signal to the processor representative of the temperature of the portion of the exhaust gas exiting the EGR cooler;

an EGR input coolant temperature sensor for producing a signal to the processor representative of the temperature of EGR coolant entering the EGR cooler from the EGR coolant supply; and an EGR outlet coolant temperature sensor for producing a signal to the processor representative of the temperature of EGR coolant exiting the EGR cooler to the EGR coolant supply; and wherein the processor determines EGR cooler efficiency in response to the temperature of the portion of the exhaust gas fed to the EGR cooler, the temperature of the portion of the exhaust gas exiting the EGR cooler, temperature of EGR coolant entering the EGR cooler and the temperature of EGR coolant exiting the EGR cooler.

9. The system recited in claim 8 wherein the EGR valve position signal is related to engine NOx.

10. The system recited in claim 8 wherein the EGR coolant valve position signal is related the temperature of EGR coolant entering the EGR.

11. The system recited in claim 9 wherein the EGR coolant valve position signal is related the temperature of EGR coolant entering the EGR.

12. The system recited in claim 7 wherein the exhaust gas recirculation (EGR) path includes:

an EGR cooler input temperature sensor for producing a signal to the processor representative of the temperature of the portion of the exhaust gas fed to the EGR cooler;

an EGR cooler output temperature sensor for producing a signal to the processor representative of the temperature of the portion of the exhaust gas exiting the EGR cooler; and wherein the processor determines EGR cooler efficiency in response to the temperature of the portion of the exhaust gas fed to the EGR cooler, and the temperature of the portion of the exhaust gas exiting the EGR cooler.

13. The system recited in claim 12 wherein the EGR valve position signal is related to engine NOx.

14. The system recited in claim 6 wherein the exhaust gas recirculation (EGR) path includes:

an EGR cooler input temperature sensor for producing a signal to the processor representative of the temperature of the portion of the exhaust gas fed to the EGR cooler;

an EGR cooler output temperature sensor for producing a signal to the processor representative of the temperature of the portion of the exhaust gas exiting the EGR cooler;

an EGR input coolant temperature sensor for producing a signal to the processor representative of the temperature of EGR coolant entering the EGR cooler from the EGR coolant supply; and an EGR outlet coolant temperature sensor for producing a signal to the processor representative of the temperature of EGR coolant exiting the EGR cooler to the EGR coolant supply; and wherein the processor determines EGR cooler efficiency in response to the temperature of the portion of the exhaust gas fed to the EGR cooler, the temperature of the portion of the exhaust gas exiting the EGR cooler, temperature of EGR coolant entering the EGR cooler and the temperature of EGR coolant exiting the EGR cooler.

15. The system recited in claim 14 wherein the EGR valve position signal is related to engine NOx.

16. The system recited in claim 15 wherein the EGR coolant valve position signal is related the temperature of EGR coolant entering the EGR.

17. The system recited in claim 14 wherein the exhaust gas recirculation (EGR) path includes:

an EGR cooler input temperature sensor for producing a signal to the processor representative of the temperature of the portion of the exhaust gas fed to the EGR cooler;

an EGR cooler output temperature sensor for producing a signal to the processor representative of the temperature of the portion of the exhaust gas exiting the EGR cooler; and wherein the processor determines EGR cooler efficiency in response to the temperature of the portion of the exhaust gas fed to the EGR cooler, and the temperature of the portion of the exhaust gas exiting the EGR cooler.

18. The system recited in claim 17 wherein the EGR valve position signal is related to engine NOx.

19. The system recited in claim 6 wherein the exhaust gas recirculation (EGR) path includes:

an EGR input coolant temperature sensor for producing a signal to the processor representative of the temperature of EGR coolant entering the EGR cooler from the EGR coolant supply; and an EGR outlet coolant temperature sensor for producing a signal to the processor representative of the temperature of EGR coolant exiting the EGR cooler to the EGR coolant supply; and wherein the processor determines EGR cooler efficiency in response to the temperature of EGR coolant entering the EGR cooler and the temperature of EGR coolant exiting the EGR cooler.

20. The system recited in claim 19 wherein the EGR coolant valve position signal is related the temperature of EGR coolant entering the EGR.

21. The system recited in claim 19 wherein the EGR valve position signal is related to engine NOx.

22. A method for operating an internal combustion engine Exhaust Gas Recirculation (EGR) system, such system having: a processor; an air intake to the engine; an exhaust gas recirculation (EGR) path for directing a portion of exhaust gas produced by the engine into the air intake; such exhaust gas recirculation path comprising: an EGR cooler for cooling the exhaust gas as such exhaust gas passes through the EGR path to the air intake; an EGR valve operative in response to an EGR valve position signal produced by the processor for controlling the amount of the exhaust gas fed to the EGR cooler, the method comprising:

producing the EGR valve position signal in accordance with a difference between actual engine exhaust NOx and a first, relatively low preset NOx level when the processor determines EGR efficiency is greater than a predetermined level; and producing, when the processor determines EGR efficiency is less than the predetermined level, the EGR valve position signal in accordance with a difference between actual engine exhaust NOx and a second, relatively high preset NOx level and producing an EGR coolant valve position signal to decrease the amount of coolant passed to the EGR cooler when such processor determines the actual EGR cooler gas outlet temperature is less than the a preset EGR cooler gas outlet temperature, such EGR valve position and EGR cooler valve position being operated to decrease the amount of exhaust gas passed to the EGR cooler and to decrease the amount of coolant passed to the EGR cooler.

* * * * *